United States Patent [19]

Rafeld

[11] 4,196,494

[45] Apr. 8, 1980

[54] CURTAIN RAIL RUNNER

[76] Inventor: Karl Rafeld, Kirnachstrasse 15-18, D-8954 Altdorf-Ebenhofen, Fed. Rep. of Germany

[21] Appl. No.: 892,339

[22] Filed: Mar. 31, 1978

[30] Foreign Application Priority Data

Apr. 4, 1977 [DE] Fed. Rep. of Germany ..... 2715017
Mar. 2, 1978 [DE] Fed. Rep. of Germany ..... 2809074

[51] Int. Cl.[2] ..... A47H 15/00
[52] U.S. Cl. ..... 16/93 D
[58] Field of Search ..... 16/96 D, 93 D, 93 R, 16/94 R, 94 D, 95 D; 24/237, 236, 241 S

[56] References Cited

U.S. PATENT DOCUMENTS 1,726,446 8/1929 McKinney ..... 24/236 X

FOREIGN PATENT DOCUMENTS 1259050 1/1968 Fed. Rep. of Germany ..... 16/93 D
2062836 7/1972 Fed. Rep. of Germany ..... 16/96 D
2006400 12/1969 France ..... 16/93 D
474988 8/1969 Switzerland ..... 16/93 D

*Primary Examiner*—George H. Krizmanich
*Attorney, Agent, or Firm*—Ralph W. Kalish

[57] ABSTRACT

A curtain rail runner having a head part slidable in the curtain rail, and a hook-shaped locking part which is adapted to be engaged in the curtain or the curtain runner fixing tape and which can be bent open manually for such engagement. This curtain rail runner can be opened much more easily when it has to be removed from the tape or the curtain itself because the closure member of the curtain rail runner has two wing members which are adapted to be pressed elastically against one another, and a nose member having a nose which is adapted to engage in the head part when the runner is in the locked position and which is adapted to be snapped out of the detent position when the runner is opened by pressing the wing members against one another.

4 Claims, 8 Drawing Figures

CURTAIN RAIL RUNNER

BACKGROUND OF THE INVENTION

The present invention relates to a curtain rail runner having a head part slidable in the curtain rail, and a hook-shaped locking part which is adapted to be engaged in the curtain or the curtain runner fixing tape and which can be bent open manually for such engagement.

Curtain rail runners of this kind usually consist of plastics and are usually removed when the curtains are cleaned or, frequently, when they are washed. For this purpose, the locking members must be bent open manually so that the runners can be withdrawn from the fixing tape loops. With the known runners this is a complicated process, because two hands are usually needed to bend open the runner and withdraw it, one hand being used to hold the head part of the runner while the other is used to bend open the hook-shaped locking member.

SUMMARY OF THE PRESENT INVENTION

It is therefore an object of the invention to provide a curtain rail runner that can be opened much more easily when it has to be removed from the tape or the curtain itself.

A further object of the invention is to eliminate the drawbacks which occur from slipping the nose of the locking part of the curtain rail runner beyond an intended detent position and reemerging on the other side of this position and thus resuming the open position of the hook-shaped locking part.

These and other objects are accomplished according to the invention in that the closure member has two wing members which are adapted to be pressed resiliently against one another, and a nose member having a nose which is adapted to engage in the head part when the runner is in the locked position and which is adapted to be snapped out of the detent position when the runner is opened by pressing the wing members against one another.

With this construction the runner can conveniently be opened and removed from the curtain with one hand, because all that is required for this purpose is to press the two wing members towards one another, and once the nose member nose has disengaged from its detent position as a result, the nose member can be withdrawn from the tape loop.

According to a preferred embodiment of the invention, the wing members may have convexly curved surfaces which are disposed in spaced relationship one opposite the other and the outer and inner edges of which extend downwardly at an angle starting from the head part. The wing members may be connected at their bottom ends to the nose member by a connecting web having a substantially horizontally extending edge, so that when the runner is in the locked position the wing members together with the nose member each form a continuous ring member.

BRIEF DESCRIPTION OF THE DRAWINGS

The foregoing and other features of the present invention will become more apparent upon consideration of the following description taken in connection with the accompanying drawings wherein:

Referring to FIGS. 1-3, the curtain rail runner comprises a head part 2 with a sliding head 4 and a neck 3, and a locking part generally designated 1. The curtain rail runner is constructed preferably of a suitable plastic material which is flexible but which, in possessing a "memory", is also resilient for automatic restoration to normal condition after withdrawing of a deforming force. Said locking part 1 essentially consists of a pair of wing members 5, 6 joined in their forward lower portions by a connecting web 10 from which progresses upwardly a nose member or locking finger 9 having a nose or locking terminal 7 in the upper end portion thereof.

Figure 1:
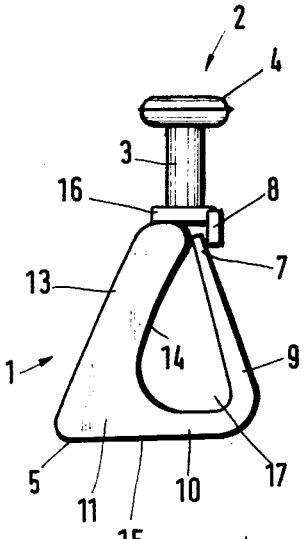
FIG. 1 is a side elevation of the curtain rail runner.
Figure 2:
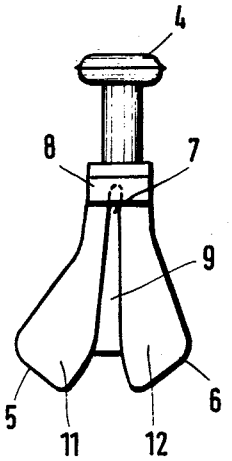
FIG. 2 is a front elevation of the curtain rail runner.

The head 4 may be of any desired design, e.g. it may be in the form of a flat stud as shown in the drawing or alternatively be of spherical construction or be in the form of a roller member. The head part is introduced into the curtain rail in known manner and is movable therein. The neck 3 adjoining the head has a collar 16 at its bottom end, the collar having at the front a downwardly bent lug 8 the inner surface of which acts as an abutment or detent (not shown) as in the nature of a small recess for the nose 7 of the nose member 9. The back of the collar 16 merges into the wing members 5,6, as will be seen from FIG. 3.

Figure 6:
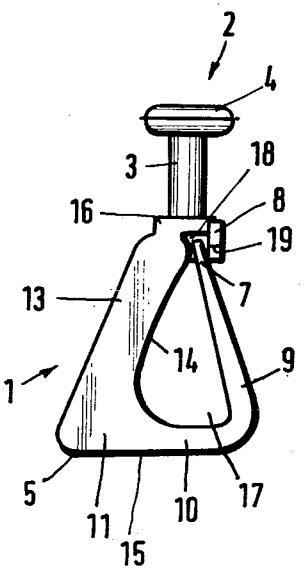
FIG. 6 is a side elevation of the embodiment of the curtain rail runner according to the invention in which the nose member is in the locked position and the nose is engaged.

Each wing member 5, 6 extends downwardly from collar 16 and contains an outer or rearward, and an inner or forward, edge 13, 14 respectively; and flares downwardly and laterally outwardly to diverge from each other in forming two convexly curved, spaced apart opposed surfaces 11, 12. Said wing surfaces 11, 12 in the lower end portions thereof merge into a connecting web 10; said latter having a substantially horizontal lower edge 15. Integral with the forward portion of web 10 is the lower end portion of nose member or locking finger 9 which extends upwardly therefrom and is of such length that nose or locking terminal 7 at the upper end thereof is adapted for locking engagement with lug 8 (see FIGS. 1, 6). Thus, as will be shown, the flexibility of nose member or locking finger 9 will permit optional locking relationship with lug 8, which is located rearwardly of the lower end of nose 9 so that when the latter is in engaged condition it will tend to be rearwardly inclined or "bent" as shown in FIGS. 1 and 6.

This curvature and this pattern of the wing members gives the locking part 1 of the curtain rail runner a butterfly wing appearance when viewed from the rear.

When the runner is in the locked position as shown in FIG. 1, the wing members 5,6, the web 10 and the nose member 9 cooperate to form a continuous ring member with an opening 17 to receive the loop of either the curtain or the runner tape.

Figure 3:
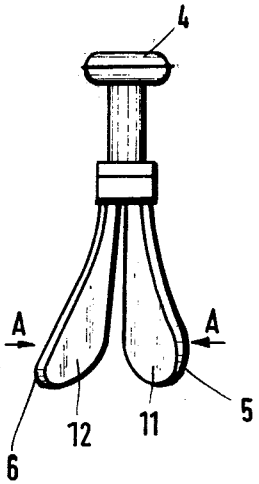
FIG. 3 is a rear elevation of the curtain rail runner.
Figure 4:
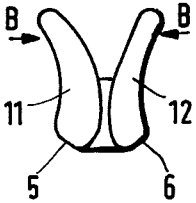
FIG. 4 is a bottom elevation of the curtain rail runner.
Figure 5:
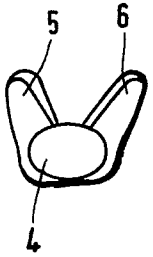
FIG. 5 is a plan view of the curtain rail runner.
Figure 8:
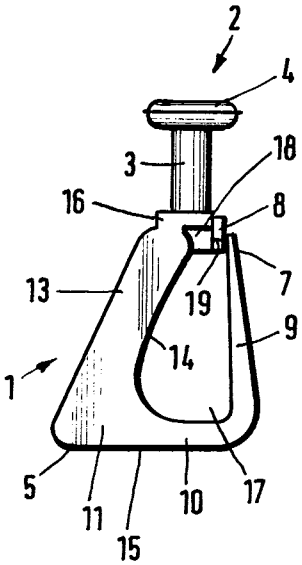
FIG. 8 is a side elevation of the curtain rail runner in which the nose member is in the open position and its nose is disengaged.

By the application of pressure upon wing surfaces 11, 12, as by gripping same between the thumb and forefinger, so as to force same toward each other, i.e., substantially as within the zones indicated by the arrows A, B indicated in FIGS. 3 and 4, an resilient deformation will be caused said wing members 5, 6 with the resultant deformation stress being transmitted by connecting web 10 to nose member or locking finger 9. Such stress will produce a force having both downward and rearward components upon the forward end portion of connecting web 10, or the lower portion of nose member 9, whereby the latter is forced to curve or to "bulge" forwardly until nose or locking terminal 7 springs or snaps from engagement with the detent developed by lug 8, bringing about an unlocked condition as illustrated in FIG. 8. If desired, with nose 7 in unlocked condition, that is, in front of lug 8 (FIG. 8), the spacing between nose 7 and lug 8 may be increased for developing an adequate entrance by further mutual compressing of wing members 5, 6, so that the opening 17 to receive the curtain or tape loop is opened and the nose 7 can be fitted into this loop. When the runner has been fitted into the loop, the nose of the nose member 9 can be manually returned into the detent position at the lug 8, and the locking member 1 can thus be re-engaged in the head part 2 of the runner by resilient deformation of the nose member 9.

This runner construction thus provides easy opening of the runner and insertion into the curtain or tape loop provided for the purpose, using the fingers of just one hand, while the other hand can hold the curtain.

The curtain rail runner may be made from an elastically deformable plastic normally used for such purposes.

Figure 7:
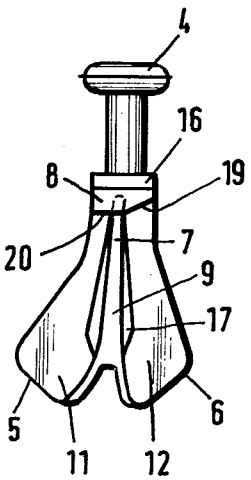
FIG. 7 is a front elevation of the curtain rail runner shown in FIG. 6.

In order to ensure that the nose 7 of the nose member has only one direction of movement on engagement behind the lug 8 and in order to prevent it from slipping beyond the intended detent position and re-emerging on the other side of the collar 16 and thus resuming the open position, the collar may, as shown in FIG. 6, have a downwardly extending side wall 18 on one side of one of the wing members 5, side wall 18 being connected to the lug 8 and forming a lateral abutment for the engaged nose 7. Engagement of the nose behind the lug can thus be effected only from that side of the collar 16 that has no side wall 18, in this case, therefore, the side on which the wing member 6 is situated, as will be apparent from the runner front view shown in FIG. 7.

FIG. 6 shows the nose of the nose member 9 in the engaged position, bearing against the inner surface of the lug 8, which may have a concave curvature in order to hold the nose more securely in the detent position.

When the nose 7 is released from its detent position behind the lug 8, the nose moves outwards beneath the bottom edge 20 (FIG. 7) of the collar, i.e., it does not leave the detent position in the opposite direction to the engagement movement but snaps out forwardly, thus releasing a gap for the introduction of a curtain tape loop into the opening 17.

The lug 8 is advantageously wider than the nose 7, as shown in the exemplified embodiments, while in addition the bottom edge 20 of the lug 8 at that end which is remote from the side wall 18 forming the abutment for the nose 7 extends upwardly at an angle and forms an edge 19 which provides better guidance of the nose 7 before it engages behind the lug 8.

Instead of being provided on the same side as the wing member 5, the side wall 18 may be provided on the same side as the wing member 6.

I claim:

1. A curtain rail runner comprising a head part slideable in a curtain rail and a hook-shaped locking part adapted for engaging a curtain or curtain runner fixing tape, said locking part being constructed of flexible, resilient material and comprising a pair of wing members, means engaging the upper ends of said wing members to said head part for extension downwardly therefrom, the head part-remote or lower end portions of said wing members being in diverging, laterally outwardly flaring relationship, said head part having a locking detent, a flexible, elongated nose member having a nose at the upper end thereof engageable within said head part locking detent, and means interengaging the lower end portion of said nose member and the lower end portions of said wing members whereby when said nose is lockingly engaged with said detent, the same may be removed therefrom by pressing the lower end portions of the wing members toward each other, thereby effecting a stressing of the nose member for causing a snap-like pull of said nose from said head part locking detent.

2. A curtain rail runner as defined in claim 1 and further characterized by said means interengaging the lower end portion of said nose member and the lower end portions of said wing members being a connecting web located spacedly downwardly of said head part.

3. A curtain rail runner as defined in claim 2 and further characterized by said wing members in the lower forward portions thereof converging forwardly merging into said connecting web, the lower end portion of said nose member being integrally formed with said connecting web remote from said wing members and projecting upwadly from said connecting web.

4. A curtain rail runner as defined in claim 3 and further characterized by said means engaging the upper ends of said wing members being a collar provided on said head part, said locking detent depending from said collar in its portion remote from engagement with said wing members.

* * * * *